US005676537A

United States Patent [19]

Fang

[11] Patent Number: 5,676,537

[45] Date of Patent: Oct. 14, 1997

[54] LOCKABLE SPARK GENERATING DEVICE FOR A LIGHTER

[75] Inventor: Ming Fang, Rowland Heights, Calif.

[73] Assignee: ERA Intermarketing Co., Inc., Rowland Hts., Calif.

[21] Appl. No.: 636,576

[22] Filed: Apr. 23, 1996

[51] Int. Cl.[6] ..... F23D 11/36

[52] U.S. Cl. ..... 431/153; 431/277

[58] Field of Search ..... 431/277, 153

[56] References Cited

U.S. PATENT DOCUMENTS

| | | | |
|---|---|---|---|
| 4,717,335 | 1/1988 | Loveless | 431/153 X |
| 4,758,152 | 7/1988 | Kordecki . | |
| 5,066,220 | 11/1991 | Vick | 431/153 X |
| 5,197,870 | 3/1993 | Yang . | |
| 5,215,458 | 6/1993 | Cerami . | |
| 5,224,854 | 7/1993 | Ansquer . | |
| 5,236,351 | 8/1993 | Tiens | 431/153 X |
| 5,288,226 | 2/1994 | Khemarangen . | |
| 5,332,387 | 7/1994 | Sheng . | |
| 5,356,286 | 10/1994 | Sher . | |
| 5,378,143 | 1/1995 | Ansquer . | |
| 5,387,101 | 2/1995 | Chan . | |
| 5,407,346 | 4/1995 | Sher . | |
| 5,409,372 | 4/1995 | Nobuo . | |
| 5,421,720 | 6/1995 | Sher . | |
| 5,439,375 | 8/1995 | Wang | 431/153 X |
| 5,490,773 | 2/1996 | Lloveras Capilla | 431/153 |

*Primary Examiner*—Carl D. Price

*Attorney, Agent, or Firm*—David & Raymond; Raymond Y. Chan

[57] ABSTRACT

A lockable spark generating device for a lighter includes a supporting frame, an ignition means and a locking means. The supporting frame is disposed on a gas reservoir having a valve which is actuated by a gas lever pivotally mounted on the supporting frame for releasing gas therefrom. The ignition means comprises a flint supported by a resilient element and a spark wheel which is rotatably mounted on the supporting frame for movement between a locking position and an ignition position. The spark wheel has a knurling surface adapted for contact by a user and rotatable by the user and a striking surface in contact with the flint. The flint is retained urging against the striking surface of the spark wheel by means of the resilient element for generating sparks directed toward the valve when the striking surface is driven to rotate against the flint by moving the knurling surface in the direction of the gas lever by the user. The locking means comprises at least a locking pawl member disposed on the supporting frame having a pawl surface adapted to engaged with the knurling surface of the spark wheel when the spark wheel is positioned in the locking position normally for stopping any rearward rotation movement of the spark wheel to prevent unexpected ignition, thereby rendering the lighter children resistant.

19 Claims, 5 Drawing Sheets

LOCKABLE SPARK GENERATING DEVICE FOR A LIGHTER

BACKGROUND OF THE PRESENT INVENTION

The present invention relates to safety lighter preventing ready actuation of the lighters by children, and more particularly to a lighter having a lockable spark generating device which comprises an ignition means normally locked by a locking means to prevent any spark generating operation unless it is manipulated to an unlock position for permitting spark generating manipulation.

A conventional safety lighter such as disclosed in U.S. Pat. No. 5,197,870 to James C. H. Yang operates by depressing an operating lever to lift a gas pipe thereby opening a gas release valve while a spark is generated by simultaneous rotation of a striker wheel in engagement with a flint has a safety mechanism for ensuring that the valve is closed when the operating lever is released. The safety mechanism includes a spring element which urges the operating lever out of engagement with the gas pipe in the released position.

However such a conventional gas lighter still has the following shortcomings:

1. An additional spring element is equipped with the lighter for urging the operating lever out of engagement with the gas pipe in the released position, which increases the manufacturing cost and procedures of the lighter. Moreover, once the spring element is mispositioned, the operating lever will be remained in engagement with the gas pipe that causes the safety mechanism malfunctioned.

2. During the igniting operation of the gas lighter, initially, an additional step of pushing the operating lever inwards to engage with the gas pipe is needed for enabling the depressing the operating lever to lift the gas pipe to open the gas release valve, which complicates the manipulation of ignition.

More conventional safety lighters, such as U.S. Pat. Nos. 5,409,372, 5,421,720, 4,758,152, 5,407,346, 5,332,387, 5,356,286, 5,288,226, 5,215,458, 5,378,143, 5,387,101, and 5,224,854, disclose various kinds of switching mechanism for rendering the lighter child resistant. Such switching mechanism provides a switch member requiting the adult user to turn on before permitting an operating lever to be depressed to lift a gas pipe to open a gas release valve while a spark is generated by simultaneous rotation of a striker wheel in engagement with a flint. However, such conventional gas lighters with switching mechanism also bear the drawbacks as follows:

1. Numerous of additional elements of the switching mechanism are required to incorporate with the traditional disposable lighter for ensuring the safety feature thereof. Such costly switching mechanism not only increases the cost of the lighter, but also increases the manufacturing procedures of the lighter.

2. During the igniting operation of the gas lighter, initially, an additional step of turning the switch member of the switching mechanism to release the locking of the operating lever is needed for enabling the depressing the operating lever to lift the gas pipe to open the gas release valve, which complicates the manipulation of ignition.

Another conventional safety lighter disclosed in U.S. Pat. No. 5,483,918 to Gerald J. Doiron comprises a shield shaped to the sparker wheel and adapted to partly cover the wheel deterring a child from turning the wheel to an extent that ignites gas from the lighter. Although such safety lighter does not require any additional manipulating step, such as pushing the operating lever or taming the switch member, in igniting operation, a downward thumb pressure must be applied to depress the shield to expose the knurling of the sparker wheel for enabling the operator's thumb to move in the direction of the gas lever simultaneously and very quickly and vigorously, to create enough spark to ignite the gas.

Certainly, since such igniting manipulation requires the operator's thumb to depress the shield and rotate the sparker wheel at the same time, it is very difficult for a young child in the age category of five years or younger to light. However, it is also found difficult to operate by an adult, especially for women, rendering such lighter against user's friendly principle.

SUMMARY OF THE PRESENT INVENTION

A main object of the present invention is to provide a lockable spark generating device for a lighter comprising an ignition means normally locked by a locking means to prevent any spark generating operation unless it is manipulated to an ignition position for permitting spark generating manipulation.

Another object of the present invention is to provide a lockable spark generating device for a lighter, in which the ignition means comprises a flint and a spark wheel which is normally mounted in a locking position for preventing any striking rotation against the flint to generate spark by means of a locking means, thereby rendering the lighter child resistant, without incorporating with any additional part or element. The spark wheel can be manipulated to the ignition position to release the locking of the spark wheel by the locking means and thus to permit the spark wheel being driven to rotate against the flint for generating spark to ignite the lighter. After each rotation of the spark wheel in the direction of the gas lever for generating spark to ignite the gas, the spark wheel will be driven to the locking position automatically again.

Another object of the present invention is to provide a lockable spark generating device for a lighter, which does not require to incorporate with any additional part or element in order to provide safety feature for preventing the children to ignite the lighter. Therefore, the manufacturing cost and procedures of the present invention remains as usual and does not need to be increased as the conventional safety lighters did.

Accordingly, a lockable spark generating device for a lighter comprises a supporting frame, an ignition means and a locking means. The supporting frame is disposed on a gas reservoir having a valve which is actuated by a gas lever pivotally mounted on the supporting frame for releasing gas therefrom. The ignition means comprises a flint supported by a resilient element and a spark wheel which is rotatably mounted on the supporting frame for movement between a locking position and an ignition position. The spark wheel has a knurling surface adapted for contact by a user and rotatable by the user and a striking surface in contact with the flint. The flint is retained urging against the striking surface of the spark wheel by means of the resilient element for generating sparks directed toward the valve when the striking surface is driven to rotate against the flint by moving the knurling surface in the direction of the gas lever by the user. The locking means comprises at least a locking pawl member disposed on the supporting frame having a pawl surface adapted to engaged with the knurling surface of the spark wheel when the spark wheel is positioned in the locking position normally.

The spark wheel is retained in the locking position of the supporting frame for normally engaging the knurling surface thereof with the pawl surface of the locking pawl member for limiting a rotation movement of the spark wheel for preventing an unexpected spark generation of the lighter. The spark wheel is operatively manipulated to the ignition position by a downward and frontward pressure applied thereon wherein the knurling surface of the spark wheel is respectively out of engagement with the pawl surface of the locking pawl member for permitting the manipulation of the spark wheel to generate sparks by rotating the knurling surface backward in the direction of the gas lever so as to rub the striking surface against the flint. When the downward and frontward pressure applied on the spark wheel is released, the upward resilient force applied on the flint by the resilient element returns the spark wheel to the locking position. Moreover, the rearward rotating movement of the spark wheel after each ignition may return the spark wheel to the locking position automatically for limiting any other rotation movement of the spark wheel for preventing any unexpected ignition of the lighter.

The supporting frame comprises a pair of respective supporting walls protruded on opposite sides of the gas lever from a frame cover sealably secured onto the gas reservoir. A pair of identical guiding slots are symmetrically formed on the two supporting walls respectively and rotatably engagable with a pair of axles provided at the sides of the spark wheel. An upper locking end of each slot is proximate to the gas lever and a lower ignition end of each slot is proximate to the valve. The axles of the spark wheel are retained positioning in the upper locking ends of the two slots respectively by means of the upward urging force of the flint and the resilient element for retaining the spark wheel in the locking position that the knurling surface of the spark wheel is engaged with the pawl surface of the pawl member to prevent any rotation movement of the spark wheel. When a downward and frontward pressure is applied to the spark wheel, the axles of the spark wheel are pushed to the lower ignition ends of the two guiding slots respectively for positioning the spark wheel in the ignition position that the knurling surface of the spark wheel is out of engagement with the pawl surface of the pawl member and thus permits rearward rotation movement of the spark wheel to rub the striking surface thereof against the flint for sparks generating. Such rearward rotation movement of the spark wheel may bring the spark wheel returning to the locking position automatically.

DETAILED DESCRIPTION OF THE PREFERRED EMBODIMENT

Figure 1:
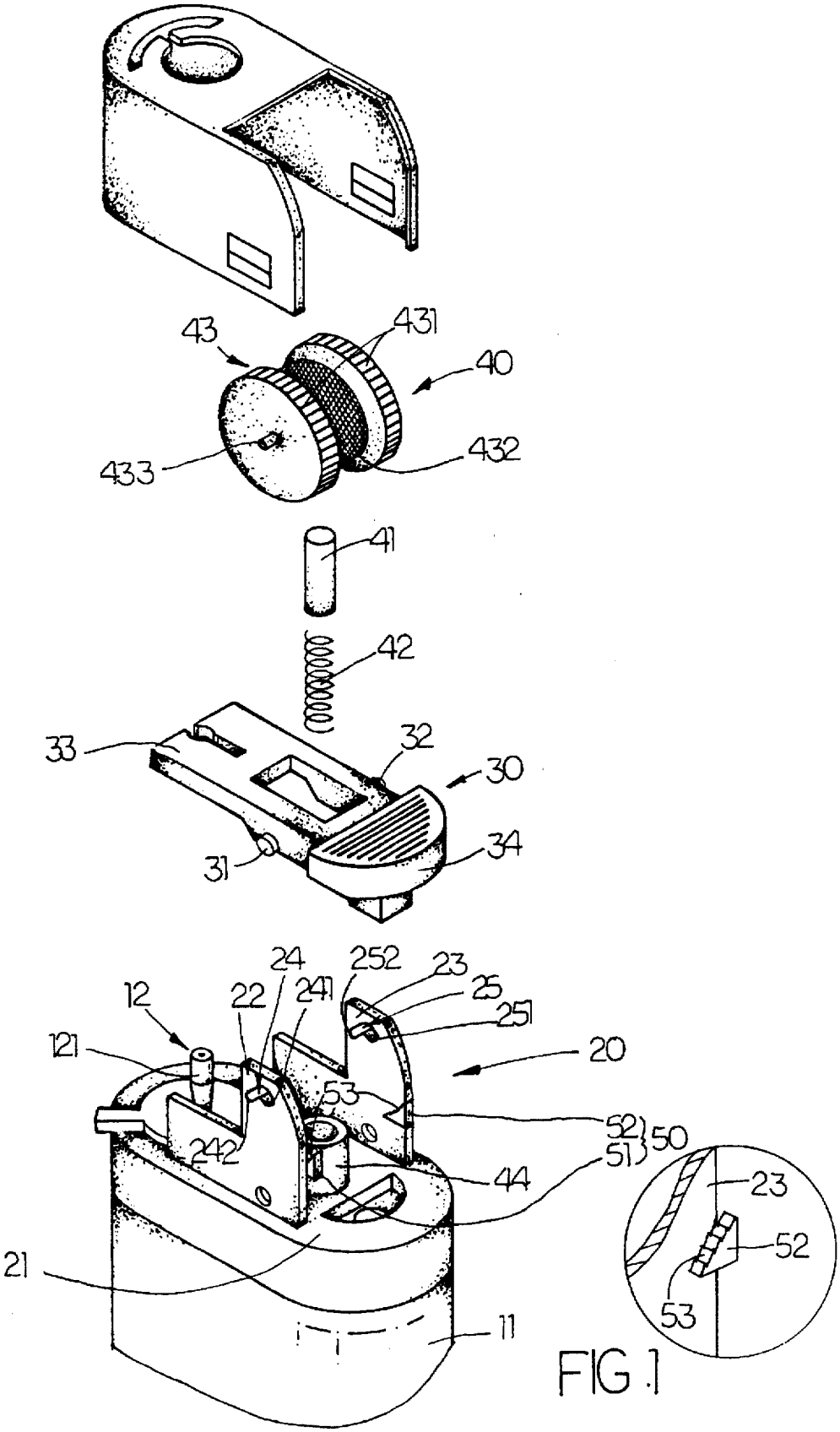
FIG. 1 is an exploded perspective view of a lockable spark generating device for a lighter according to a first preferred embodiment of the present invention.
Figure 2A:
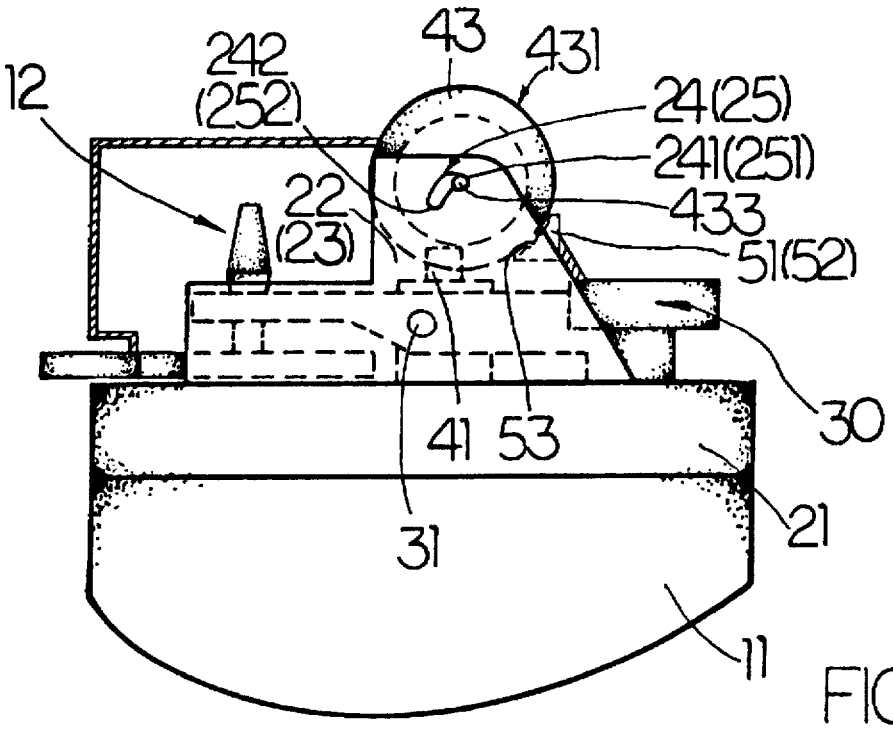
FIG. 2A is an illustrating view of a lockable spark generating device for a lighter in a locking position according to the above first embodiment of the present invention.
Figure 2B:
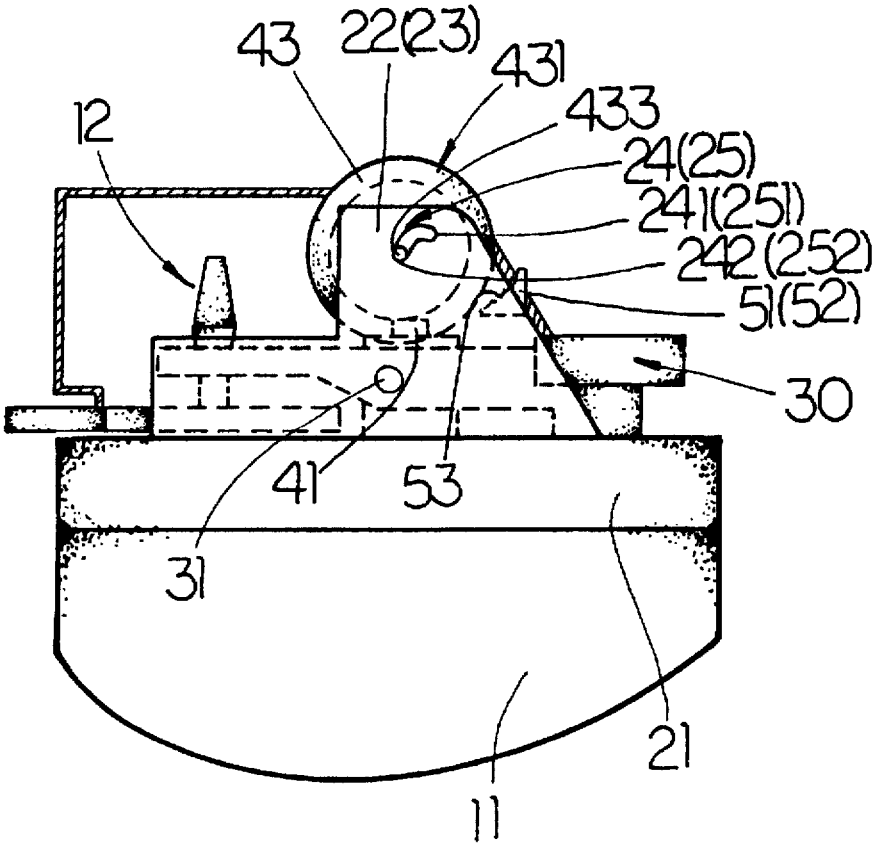
FIG. 2B is an illustrating view of a lockable spark generating device for a lighter in an ignition position according to the above first embodiment of the present invention.

Referring to FIGS. 1, 2A and 2B of the drawings, a lockable spark generating device for a lighter of the present invention comprises a supporting frame 20, an ignition means 40 and a locking means 50. The supporting frame 20 is disposed on a gas reservoir 11 having a valve 12 which is actuated by a gas lever 30 pivotally mounted on the supporting frame 20 for releasing gas therefrom. The supporting frame 20 is protruded from a frame cover 21 sealably secured onto the gas reservoir 11 filled with liquid petroleum gas such as butane therein.

The supporting frame 20 comprises a pair of respective supporting walls 22, 23 protruded on opposite sides of the gas lever 30. The gas lever 30 is pivotally mounted between the two supporting walls 22, 23 by means of two pivots 31, 32 protruded from two opposite sides of the gas lever 30. The gas lever 30 has a front end 33 extending frontwards to engage with a nozzle 121 of the gas valve 12 and a depressable rear end 34 extending rearward of the frame cover 21 for enabling the depressing of the depressable rear end 34 for lifting up the gas nozzle 121 to open the gas valve 12.

A pair of identical guiding slots 24, 25 are symmetrically formed on the two supporting walls 22, 23 respectively. Each of the guiding slots 24, 25 has an upper locking end 241, 251 proximate to the depressable rear end 34 of the gas lever 30 and a lower ignition end 242, 252 proximate to the gas valve 12. The two guiding slots 24, 25 are symmetrically extended form their upper locking ends 241, 251 frontwardly and downwardly in an arcuate shape to their lower ignition ends 242, 252 respectively.

The ignition means 40 comprises a flint 41 supported by a resilient element 42 and a spark wheel 43 which is rotatably mounted on the supporting frame 20 for movement between a locking position and an ignition position, as shown in FIGS. 2A and 2B. The spark wheel 43 has a knurling surface 431 positioned at the two circumference edges thereof and adapted for contact by a user and being rotatable by the user. The spark wheel 43 further has a central circular striking surface 432 which is smaller in diameter than the knurling surface 431 and in contact with the flint 41.

The flint 41 and the resilient element 42 are received in a flint housing 44 which is underneath the spark wheel 43 and provided on the frame cover 21 between the two supporting walls 22, 23. An upper portion of the flint 41 must be retained exposing outside the flint housing 44 and urging against the striking surface 432 of the spark wheel 43 by means of the resilient element 42 for generating sparks directed toward the gas valve 12 when the striking surface 432 is driven to rotate against the flint 41 by moving the knurling surface 431 in the rearward direction of the gas lever 30 by the user.

In accordance with this first embodiment, as shown in FIG. 1, the locking means 50 comprises a pair of locking pawl members 51, 52 symmetrically disposed on the two supporting walls 22, 23 of the supporting frame 20. Each of the locking pawl members 51, 52 has an inclined pawl surface 53 having a plurality engaging teeth thereon adapted to engaged with the knurling surface 431 of the spark wheel 43 when the spark wheel 43 is positioned in the locking position, as shown in FIG. 2A, normally.

Each pawl member 51, 52 is protruded from a rear edge of the corresponding supporting wall 22, 23 in a position below the guiding slots 24, 25 in such a manner that each inclined pawl surface 53 of the pawl member 51, 52 is confronted and tangential with the knurling surface 431 of the spark wheel 43.

Two central axles 433 are protruded from two sides of the spark wheel 43 having a predetermined size that capable of sliding along the two guiding slots 24, 25 of the supporting walls 22, 23 respectively. Therefore, the axles 433 of the spark wheel 43 are retained positioning in the upper locking ends 241, 251 of the two slot 24, 25 respectively by means of the upward urging force of the flint and the resilient element for retaining the spark wheel 43 in the locking position. As shown in FIG. 2A, normally, the spark wheel 43 is retained in the locking position of the supporting frame 20 for engaging the knurling surface 431 thereof with the pawl surfaces 53 of the locking pawl members 51, 52 for limiting a rotation movement of the spark wheel 43 for preventing an unexpected spark generation of the lighter.

As shown in FIG. 2B, when a downward and frontward pressure is applied to the spark wheel 43, the axles 433 of the spark wheel 43 are slidably pushed to the lower ignition ends 242, 252 of the two guiding slots 24, 25 respectively for positioning the spark wheel 43 in the ignition position that the striking surface 432 of the spark wheel 43 is out of engagement with the pawl surfaces 53 of the pawl members 52, 53. In the other words, the spark wheel 43 is operatively manipulated to generate sparks by rotating the knurling surface 431 rearward in the direction of the gas lever 30 so as to rub the striking surface 432 against the flint 41.

If the downward and frontward pressure applied on the spark wheel 43 is released, the upward resilient force applied to the flint 41 by the resilient element 42 returns the spark wheel 43 to the locking position, as shown in FIG. 2A, so as to ensure the spark wheel 43 retained in the locking position normally to prevent ignition, thereby rendering the lighter child resistant.

Moreover, such rearward igniting rotation movement of the spark wheel 43 after each ignition also has a tendency of returning the spark wheel 43 to the locking position automatically for limiting any other rotation movement of the spark wheel 43 for preventing any unexpected ignition of the lighter.

Figure 3:
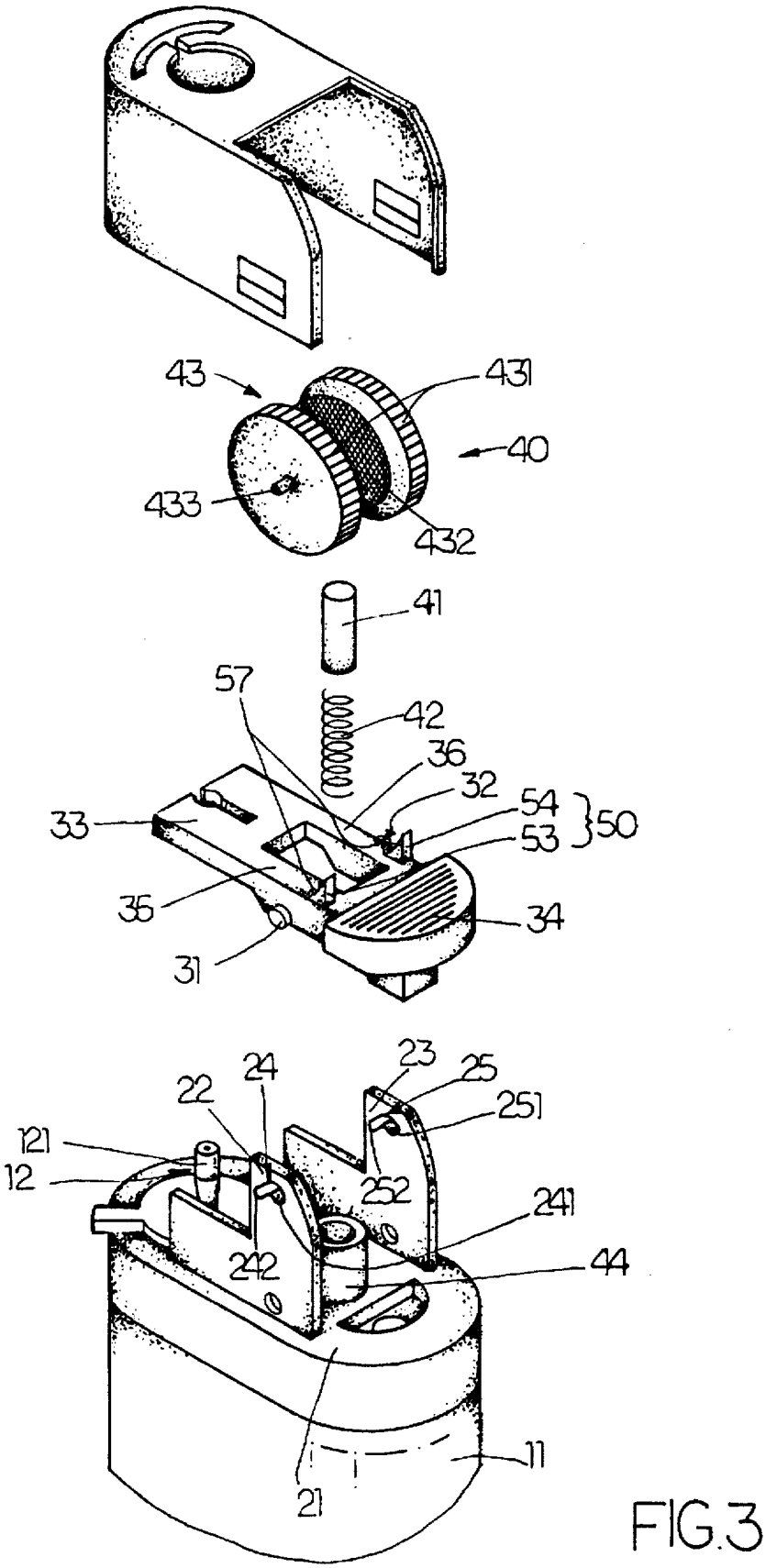
FIG. 3 is an exploded perspective view of a lockable spark generating device for a lighter according to a second preferred embodiment of the present invention.
Figure 4A:
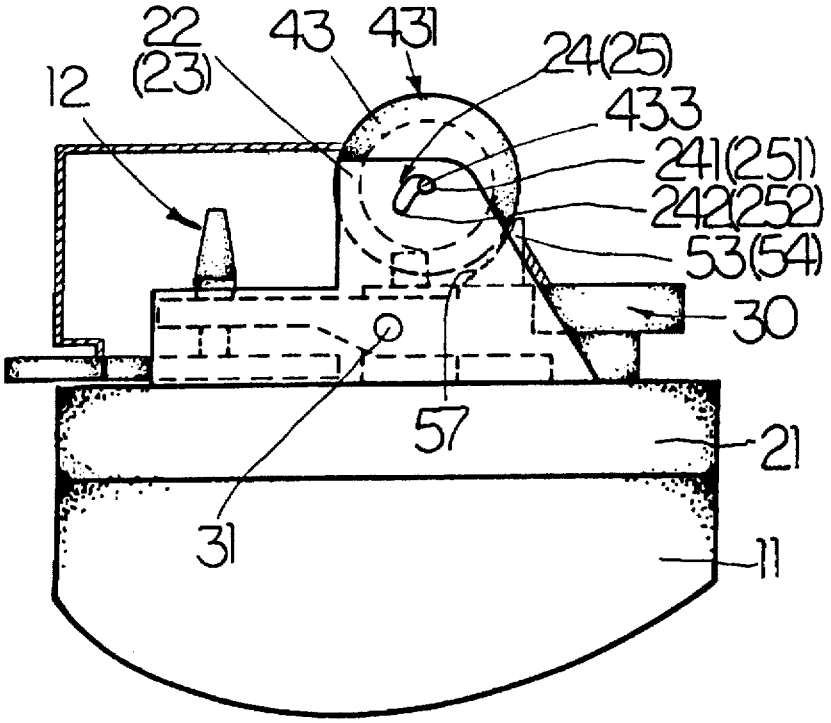
FIG. 4A is an illustrating view of a lockable spark generating device for a lighter in a locking position according to the above second embodiment of the present invention.
Figure 4B:
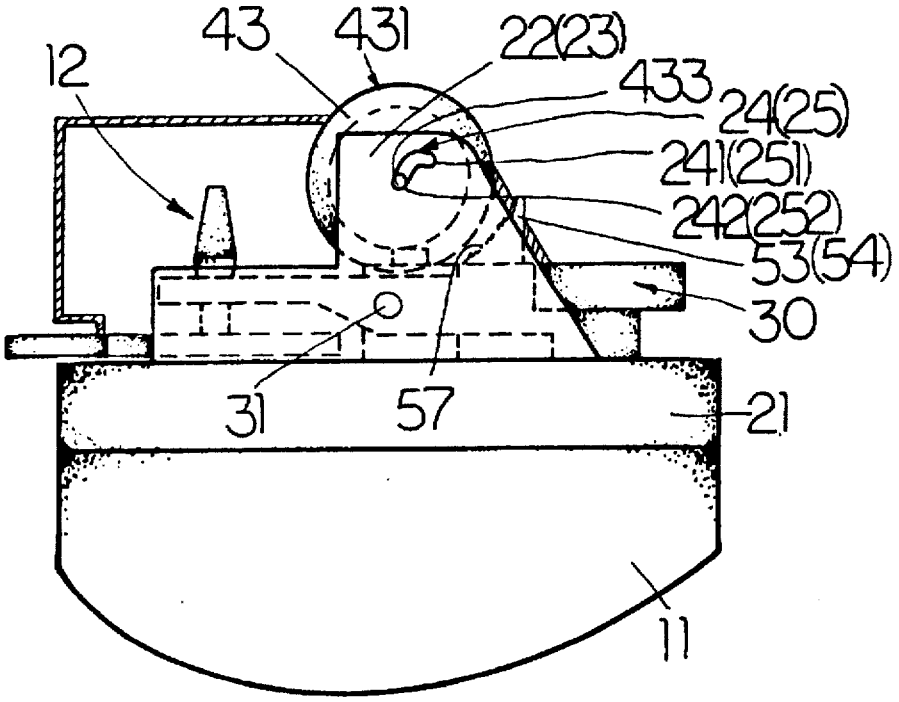
FIG. 4B is an illustrating view of a lockable spark generating device for a lighter in an ignition position according to the above second embodiment of the present invention.

Referring to FIGS. 3, 4A and 4B, a lockable spark generating device for a lighter according to a second embodiment of the present invention is illustrated, in which the supporting frame 20 and the ignition means 40 have the same configuration of the above first embodiment. The modification of this second embodiment is the locking means 50 which comprising a pair of locking pawl members 53, 54 symmetrically disposed on two parallel top sides 35, 36 of the gas lever 30. Each of the locking pawl members 53, 54 has an inclined top pawl surface 57 having a plurality engaging teeth thereon adapted to engaged with the knurling surface 431 of the spark wheel 43 when the spark wheel 43 is normally positioned in the locking position, as shown in FIG. 4A.

Each of the pawl members 53, 54 is protruded upwardly from the two sides 35, 36 of the gas lever 30 in a position below the guiding slots 24, 25 in such a manner that each inclined pawl surface 57 of the pawl member 53, 54 is confronted and tangential with the knurling surface 431 of the spark wheel 43. Accordingly, when a downward and frontward pressure is applied to the spark wheel 43, the axles 433 of the spark wheel 43 are pushed to the lower ignition ends 242, 252 of the two guiding slots 24, 25 respectively for positioning the spark wheel 43 in the ignition position, as shown in FIG. 4B, wherein the knurling surface 431 of the spark wheel 43 is out of engagement with the pawl surfaces 57 of the pawl members 53, 54 and thus permits rearward rotation movement of the spark wheel 43 to rub the striking surface 432 thereof against the flint 41 for sparks generating. Such rearward rotation movement of the spark wheel 43 may bring the spark wheel 43 returning to the locking position automatically, as shown in FIG. 4A.

Figure 5A:
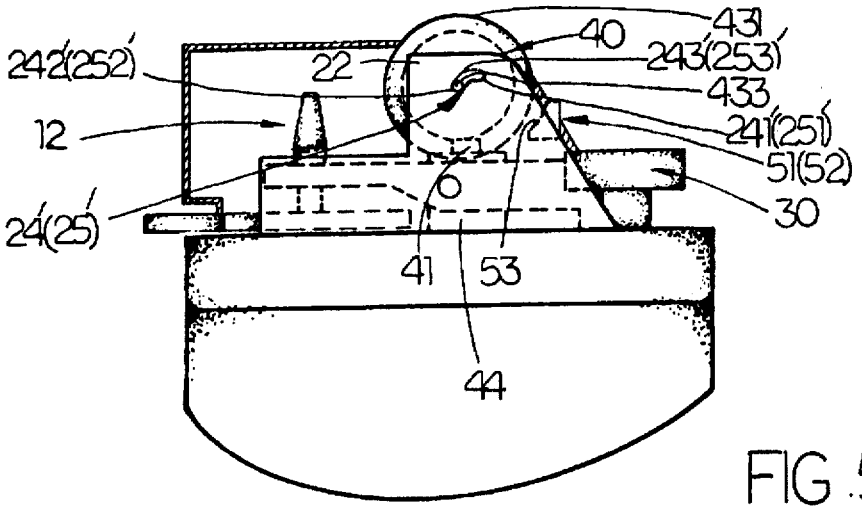
FIG. 5A is a schematic view illustrating a first alternative mode of the guiding slot of the supporting frame.

Referring to FIG. 5A, a first alternative mode of the guiding slots 24, 25 of the first embodiment is illustrated, in which each of the guiding slots 24', 25' has a middle tip portion 243', 253' extending frontwards and downwards to the ignition end 242', 252' and extending rearwards and downwards to the locking end 241', 251' to form a L-shaped arcuate slot. Normally, the axles 433 of the spark wheel 43 are pushed to retained in the middle tip portions 243' and 253' of the guiding slots 24' and 25' respectively by means of the upward urging force from the flint 41. When a downward and frontward pressure is applied to the spark wheel 43, the axles 433 of the spark wheel 43 are slidably pushed to the ignition ends 242', 252' for positioning the spark wheel 43 in the ignition position that the knurling surface 431 of the spark wheel 43 is out of engagement with the pawl surface 53 of the pawl members 51, 52 permitting the rearward rotation movement of the spark wheel 43 to generate sparks. However, without initially applying the downward and frontward pressure to the spark wheel 43, merely rearward rotation movement of the spark wheel 43 will just drive the spark wheel 43 to the locking position that the axles 433 of the spark wheel 43 are pulled to the locking ends 241' and 251' of the guiding slots 24', 25' respectively wherein the knurling surface 431 of the spark wheel 43 is engaged with the pawl surfaces 53 of the pawl members 51, 52 to stop any rotation movement of the spark wheel 43 for preventing ignition.

Figure 5B:
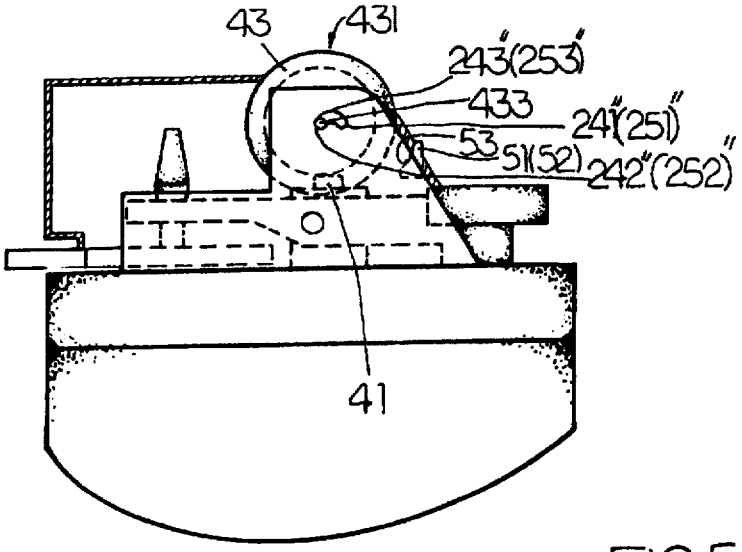
FIG. 5B is a schematic view illustrating a second alternative mode of the guiding slot of the supporting frame.

Referring to FIG. 5B, a second alternative mode of the guiding slots 24, 25 of the first embodiment is illustrated, in which each of the guiding slots 24", 25" has a middle tip 243", 253" which extends frontwards and downwards to the ignition end 242", 252" and extends rearwards and downwards to the locking end 241", 251" to form a reversed V-shaped arcuate slot. Normally, the axles 433 of the spark wheel 43 are pushed to retained in the middle tips 243" and 253" of the guiding slots 24" and 25" respectively by means of the upward urging force from the flint 41. When a downward and frontward pressure is applied to the spark wheel 43, the axles 433 of the spark wheel 43 are slidably pushed to the ignition ends 242", 252" for positioning the spark wheel 43 in the ignition position that the knurling surface 431 of the spark wheel 43 is out of engagement with the pawl surface 53 of the pawl members 51, 52 permitting the rearward rotation movement of the spark wheel 43 to generate sparks. However, without initially applying the downward and frontward pressure to the spark wheel 43, merely applying a rearward rotation movement of the spark wheel 43 will just drive the spark wheel 43 to the locking position that the axles 433 of the spark wheel 43 are pulled to the locking ends 241" and 251" of the guiding slots 24", 25" respectively wherein the knurling surface 431 of the spark wheel 43 is engaged with the pawl surfaces 53 of the pawl members 51, 52 to stop any rotation movement of the spark wheel 43 for preventing ignition.

Figure 5C:
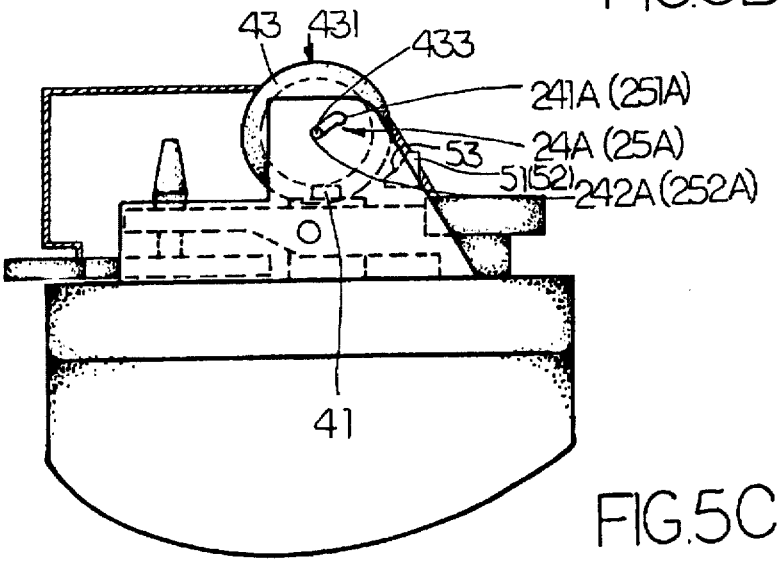
FIG. 5C is a schematic view illustrating a third alternative mode of the guiding slot of the supporting frame.

Referring to FIG. 5C, a third alternative mode of the guiding slots 24, 25 of the first embodiment is illustrated, in which each of the guiding slots 24*a*, 25*a* is an inclined straight slot having an upper locking end 241*a*, 251*a* and a lower ignition end 242*a*, 252*a*, wherein the upper locking ends 241*a*, 251*a* have a size slightly larger than the that of the lower ignition ends 2421, 252*a*. Normally, the axles 433 of the spark wheel 43 are pushed to retained in the upper locking ends 241*a*, 242*a* of the guiding slots 24*a* and 25*a* respectively by means of the upward urging force from the flint 41 for positioning the spark wheel 43 in the locking position that the knurling surface 431 of the spark wheel 43 is engaged with the pawl surfaces 53 of the pawl members 51, 52 to prevent any rearward rotation movement of the spark wheel 43. When a downward and frontward pressure is applied to the spark wheel 43, the axles 433 of the spark wheel 43 are slidably pushed to the ignition ends 242*a*, 252*a* for positioning the spark wheel 43 in the ignition position that the hurling surface 431 of the spark wheel 43 is out of engagement with the pawl surface 53 of the pawl members 51, 52 permitting the rearward rotation movement of the spark wheel 43 to generate sparks.

It is obvious that the above three alternative modes of the mounting slots can also be applied to the second embodiment.

In accordance with the above embodying disclosure, a lighter having a lockable spark generating device of the present invention does not require to incorporate with any additional part or element in order to provide safety feature for preventing the children to ignite the lighter. Therefore, the manufacturing cost and procedures of the present invention remains as usual and does not need to be increased as the conventional safety lighters did.

I claim:

1. A lockable spark generating device for a lighter, comprising a supporting frame disposed on a gas reservoir having a valve which is actuated by a gas lever pivotally mounted on said supporting frame for actuating said valve to release gas within said gas reservoir therefrom, wherein said supporting frame comprises a pair of respective supporting walls protruded on opposite sides of said gas lever from a frame cover sealably secured onto said gas reservoir, a pair of identical guiding slots being symmetrically formed on said two supporting walls respectively;

an ignition means comprising a flint supported by a resilient element and a spark wheel which is rotatably mounted on said supporting frame for movement between a locking position and an ignition position, said spark wheel having a pair of axles provided at two sides thereof for rotatably engaging with said guiding slots, said spark wheel having a knurling surface adapted for contact by a user and being rotatable by said user and a striking surface in contact with said flint, said knurling surface of said spark wheel being positioned at two circumference edges of said spark wheel and said striking surface being formed in a central circular surface of said spark wheel which is smaller in diameter than said knurling surface, wherein said flint is retained urging against said striking surface of said spark wheel by means of said resilient element for generating sparks directed toward said valve when said striking surface is driven to rotate against said flint by moving said knurling surface in a rearward direction of said gas lever; and a locking means comprising a pair of locking pawl members symmetrically disposed on said two supporting walls of said supporting frame, each of said locking pawl members having an inclined pawl surface which has a plurality of engaging teeth thereon adapted to engaged with said knurling surface of said spark wheel when said spark wheel is positioned in said locking position normally, each said pawl member being protruded from a rear edge of said corresponding supporting wall in a position below said guiding slots in such a manner that each said inclined pawl surface of each said pawl member is confronted and tangential with said knurling surface of said spark wheel, in which said spark wheel is retained in said locking position of said supporting frame for normally engaging said knurling surface thereof with said two pawl surfaces of said locking pawl members for limiting a rotation movement of said spark wheel for preventing an unexpected spark generating of said lighter, therefore when said spark wheel is operatively manipulated to said ignition position by a downward and frontward pressure applied thereon, said knurling surface of said spark wheel is out of engagement with said two pawl surfaces of said two locking pawl members for permitting said manipulation of said spark wheel to generate sparks by rotating said knurling surface backwards so as to rub said striking surface against said flint.

2. A lockable spark generating device for a lighter, as recited in claim 1, in which each of said guiding slots has an upper locking end proximate to said gas lever and a lower ignition end proximate to said valve, so that said axles of said spark wheel are retained positioning in said upper locking ends of said two slots respectively by means of an upward urging force of said flint and said resilient element for retaining said spark wheel in said locking position that said knurling surface of said spark wheel is engaged with said two pawl surfaces of said two pawl members to prevent any rotation movement of said spark wheel, therefore when a down ward and frontward pressure is applied to said spark wheel, said axles of said spark wheel are slidably pushed to said lower ignition ends of said two guiding slots respectively for positioning said spark wheel in said ignition position that said knurling surface of said spark wheel is out of engagement with said two pawl surfaces of said two pawl members and thus permits rearward rotation movement of said spark wheel to rub said striking surface thereof against said flint for sparks generating, and that said rearward rotation movement of said spark wheel drives said spark wheel returning to said locking position automatically.

3. A lockable spark generating device for a lighter, as recited in claim 2, in which said two guiding slots are symmetrically extended form said upper locking ends thereof frontwardly and downwardly in an arcuate shape to said lower ignition ends thereof respectively.

4. A lockable spark generating device for a lighter, as recited in claim 3, in which said flint and said resilient element are received in a flint housing which is underneath said spark wheel and provided on said frame cover between said two supporting walls wherein an upper portion of said flint must be retained exposing outside said flint housing for generating sparks directed towards said gas valve and be kept urging against said striking surface of said spark wheel by means of said resilient element in both said locking position and said ignition position.

5. A lockable spark generating device for a lighter, as recited in claim 4, in which said two central axles protruded from two sides of said spark wheel have a predetermined size that capable of sliding along said two guiding slots of said supporting walls respectively, wherein said axles of said spark wheel are retained positioning in said upper locking ends of said two guiding slots respectively by means of said upward urging force of said flint and said resilient element for retaining said spark wheel in said locking position, and wherein when a downward and frontward pressure is applied to said spark wheel, said two axles of said spark wheel are pushed to said lower ignition ends of said two guiding slots respectively for positioning said spark wheel in said ignition position that said striking surface of said spark wheel is out of engagement with said pawl surfaces of said pawl members.

6. A lockable spark generating device for a lighter, as recited in claim 5, in which each of said guiding slots further forms a middle tip portion which extends frontwards and downwards to said ignition end and extends rearwards and downwards to said locking end to form a L-shaped arcuate slot.

7. A lockable spark generating device for a lighter, as recited in claim 5, in which each of said guiding slots has a middle tip portion which extends frontwards and downwards to said ignition end and extends rearwards and downwards to said locking end to form a V-shaped arcuate slot.

8. A lockable spark generating device for a lighter, as recited in claim 5, in which each of said guiding slots is an inclined straight slot which has a top end forming said upper locking end and a bottom end forming said lower ignition end.

9. A lockable spark generating device for a lighter, as recited in claim 1, in which said flint and said resilient element are received in a flint housing which is underneath said spark wheel and provided on said frame cover between said two supporting walls wherein an upper portion of said flint must be retained exposing outside said flint housing for generating sparks directed towards said gas valve and be kept urging against said striking surface of said spark wheel by means of said resilient element in both said locking position and said ignition position.

10. A lockable spark generating device for a lighter, comprising a supporting frame disposed on a gas reservoir having a valve which is actuated by a gas lever pivotally mounted on said supporting frame for actuating said valve to release gas within said gas reservoir therefrom;

an ignition means comprising a flint supported by a resilient element and a spark wheel which is rotatably mounted on said supporting frame for movement between a locking position and an ignition position, said spark wheel having a knurling surface adapted for contact by a user and being rotatable by said user and a striking surface in contact with said flint, said knurling surface of said spark wheel being positioned at two circumference edges of said spark wheel and said striking surface being formed in a central circular surface of said spark wheel which is smaller in diameter than said knurling surface, wherein said flint is retained urging against said striking surface of said spark wheel by means of said resilient element for generating sparks directed toward said valve when said striking surface is driven to rotate against said flint by moving said knurling surface in a rearward direction of said gas lever; and a locking means comprising a pair of locking pawl members symmetrically disposed on two parallel top sides of said gas lever, wherein each of said locking pawl members has an inclined top pawl surface having a plurality of engaging teeth thereon adapted to engaged with said knurling surface of said spark wheel when said spark wheel is normally positioned in said locking position, wherein said inclined pawl surface of said pawl member is confronted and tangential with said knurling surface of said spark wheel, in which said spark wheel is retained in said locking position of said supporting frame for normally engaging said knurling surface thereof with said pawl surface of said locking pawl member for limiting a rotation movement of said spark wheel for preventing an unexpected spark generating of said lighter, therefore when said spark wheel is operatively manipulated to said ignition position by a downward and frontward pressure applied thereon, said knurling surface of said spark wheel is out of engagement with said pawl surface of said two locking pawl member for permitting said manipulation of said spark wheel to generate sparks by rotating said knurling surface backwards so as to rub said striking surface against said flint.

11. A lockable spark generating device for a lighter, as recited in claim 10, in which said supporting frame comprises a pair of respective supporting walls protruded on opposite sides of said gas lever from a frame cover sealably secured onto said gas reservoir, a pair of identical guiding slots being symmetrically formed on said two supporting walls respectively, said spark wheel having a pair of axles provided at two sides thereof for rotatably engaging with said guiding slots.

12. A lockable spark generating device for a lighter, as recited in claim 11, in which each of said pawl members is protruded upwardly from said two sides of said gas lever in a position below said guiding slots.

13. A lockable spark generating device for a lighter, as recited in claim 12, in which each of said guiding slots has an upper locking end proximate to said gas lever and a lower ignition end proximate to said valve, so that said axles of said spark wheel are retained positioning in said upper locking ends of said two slots respectively by means of an upward urging force of said flint and said resilient element for retaining said spark wheel in said locking position that said knurling surface of said spark wheel is engaged with said two pawl surfaces of said two pawl members to prevent any rotation movement of said spark wheel, therefore when a down ward and frontward pressure is applied to said spark wheel, said axles of said spark wheel are slidably pushed to said lower ignition ends of said two guiding slots respectively for positioning said spark wheel in said ignition position that said knurling surface of said spark wheel is out of engagement with said two pawl surfaces of said two pawl members and thus permits rearward rotation movement of said spark wheel to rub said striking surface thereof against said flint for sparks generating, and that said rearward rotation movement of said spark wheel drives said spark wheel returning to said locking position automatically.

14. A lockable spark generating device for a lighter, as recited in claim 13, in which said two guiding slots are symmetrically extended form said upper locking ends thereof frontwardly and downwardly in an arcuate shape to said lower ignition ends thereof respectively.

15. A lockable spark generating device for a lighter, as recited in claim 14, in which said flint and said resilient element are received in a flint housing which is underneath said spark wheel and provided on said frame cover between said two supporting walls wherein an upper portion of said flint must be retained exposing outside said flint housing for generating sparks directed towards said gas valve and be kept urging against said striking surface of said spark wheel by means of said resilient element in both said locking position and said ignition position.

16. A lockable spark generating device for a lighter, as recited in claim 15, in which said two central axles protruded from two sides of said spark wheel have a predetermined size that capable of sliding along said two guiding slots of said supporting walls respectively, wherein said axles of said spark wheel are retained positioning in said upper locking ends of said two guiding slots respectively by means of said upward urging force of said flint and said resilient element for retaining said spark wheel in said locking position, and wherein when a downward and frontward pressure is applied to said spark wheel, said two axles of said spark wheel are pushed to said lower ignition ends of said tow guiding slots respectively for positioning said spark wheel in said ignition position that said striking surface of said spark wheel is out of engagement with said pawl surfaces of said pawl members.

17. A lockable spark generating device for a lighter, as recited in claim 16, in which each of said guiding slots further forms a middle tip portion which extends frontwards and downwards to said ignition end and extends rearwards and downwards to said locking end to form a L-shaped arcuate slot.

18. A lockable spark generating device for a lighter, as recited in claim 16, in which each of said guiding slots has a middle tip portion which extends frontwards and downwards to said ignition end and extends rearwards and downwards to said locking end to form a V-shaped arcuate slot.

19. A lockable spark generating device for a lighter, as recited in claim 16, in which each of said guiding slots is an inclined straight slot which has a top end forming said upper locking end and a bottom end forming said lower ignition end.

* * * * *